United States Patent [19]

Heath

[11] 4,026,535

[45] May 31, 1977

[54] MODEL AIRCRAFT CONSTRUCTION JIG

[76] Inventor: Vernon Ernest Heath, 28 Springfield Road Walmley,, Sutton Coldfield West Midlands, England

[22] Filed: June 25, 1975

[21] Appl. No.: 590,188

[30] Foreign Application Priority Data

Mar. 27, 1975 United Kingdom ..... 12819/75

[52] U.S. Cl. ..... 269/45; 144/288 B; 269/152; 269/321 W

[51] Int. Cl.[2] ..... B25B 1/20

[58] Field of Search ..... 269/40, 45, 95, 99, 269/100, 101, 104, 152, 321 A, 321 W; 29/200 J, 200 P; 144/288 B

[56] References Cited

UNITED STATES PATENTS

| | | | |
|---|---|---|---|
| 288,035 | 11/1883 | Dixon | 269/45 |
| 410,414 | 9/1889 | Hall | 269/45 |
| 842,007 | 1/1907 | Parker | 269/45 |
| 2,342,025 | 2/1944 | Watter | 29/200 J |
| 3,908,976 | 9/1975 | Petrinec | 269/321 W |

*Primary Examiner*—Harold D. Whitehead

*Assistant Examiner*—Robert C. Watson

*Attorney, Agent, or Firm*—Lowe, King, Price & Markva

[57] ABSTRACT

A model aircraft construction jig includes an elongate baseboard, a plurality of fuselage side cramp members, means for fixing the side cramp members on the baseboard, a tail unit locator and means for fixing the tail unit locator on the baseboard. The baseboard has at least one longitudinal guide line defining a reference center line, and the side cramp members are positionally adjustable so as to be arranged in rows spaced at opposite sides of the center line so that clamping faces thereof can engage respective side walls of a fuselage assembled on the center line. The tail unit locator is also mounted and fixed in selective predetermined relationship to said center line and has an angularly and vertically adjustable forwardly-projecting arm having open-ended guide slot means adapted to engage and locate in position the tail fin and rudder portion and the tail plane and elevator portions of a tail unit during construction and fitting thereof to a fuselage held between the side cramp members and aligned with said center line.

9 Claims, 8 Drawing Figures

FIG. 1.
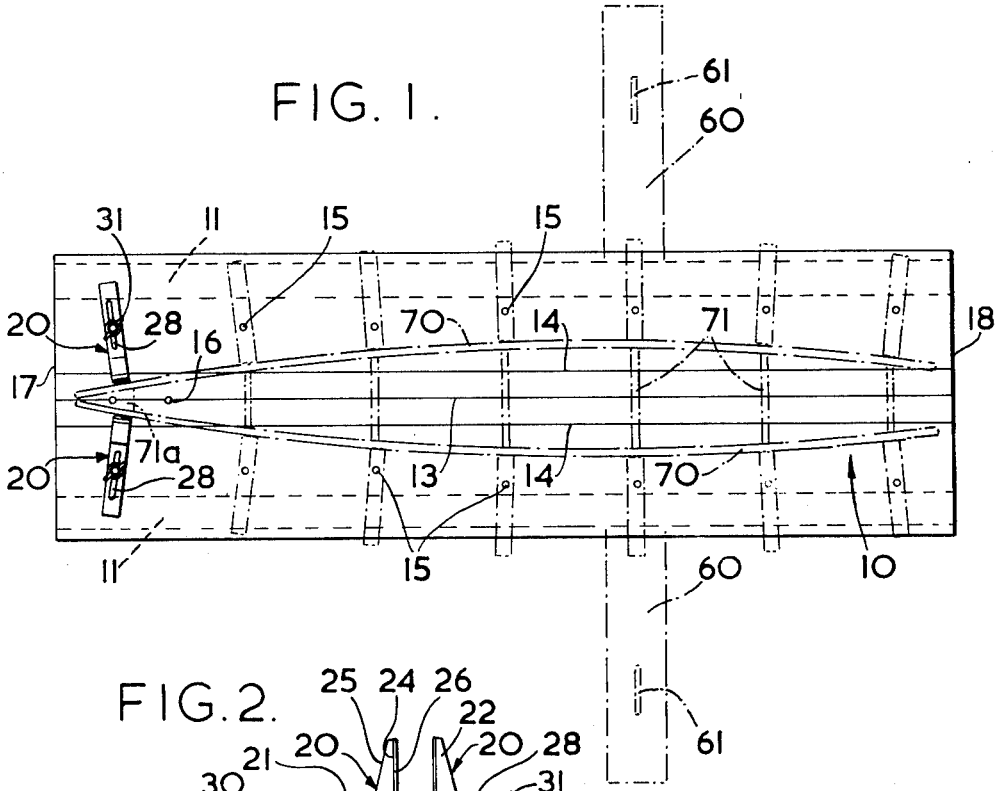
FIG. 2.
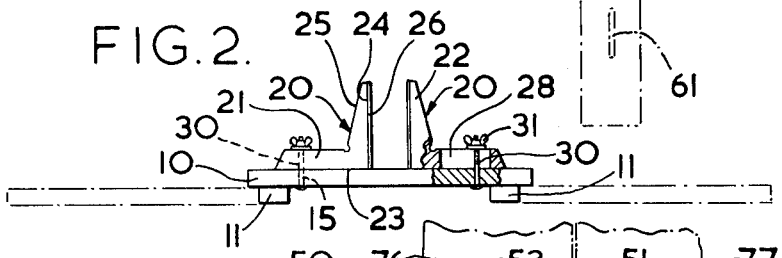
FIG. 3.
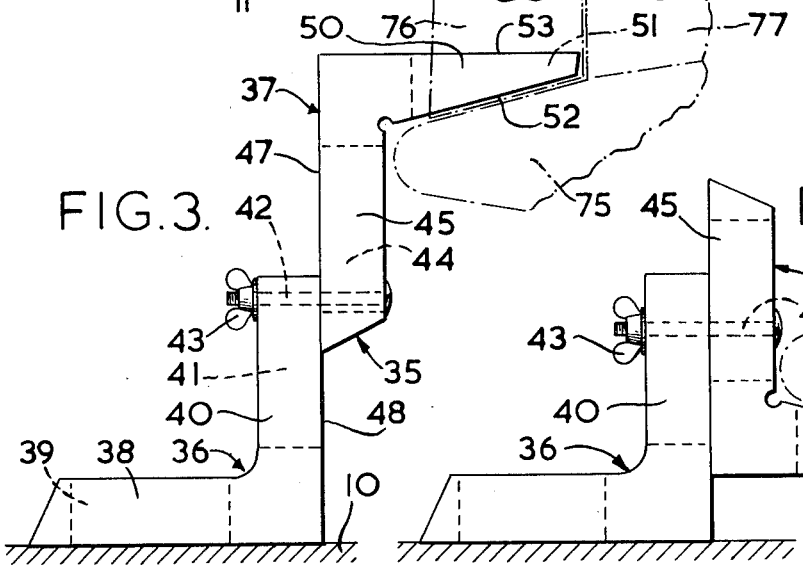
FIG. 4.

MODEL AIRCRAFT CONSTRUCTION JIG

BACKGROUND OF THE INVENTION

This invention relates to model aircraft construction jigs.

An object of the invention is to provide a versatile improved form of construction jig which can facilitate the building of at least fuselage and tail unit assemblies of model aircraft using conventional adhesively-bonded plywood and/or balsa wood construction techniques, and the invention can be especially useful for providing construction jigs for building flying models of aircraft, such as radio controlled models, in which a high degree of precision is required in assembly and alignment, particularly in respect of the fuselage and tail unit.

In conventional techniques of model aircraft construction, the fuselage is built up in balsa or plywood from a pair of elongate side walls assembled in spaced-apart relationship and interconnected to form a framework by a plurality of spacing formers, usually of small laminate shape, which extend transversely between the side wall pieces in vertical planes perpendicular to the longitudinal axis of the fuselage and which are spaced apart at intervals along the length. The formers are glued or bonded by adhesive along their edges to the inwardly-presented faces of the side wall pieces and, by their individual dimensions and relative dispositions, they collectively determine the overall profile of the fuselage framework which is subsequently covered with appropriate sheeting. After building the fuselage framework, the tail unit, comprising tail plane portions with elevators and, usually, a tail fin portion with rudder, is built on, after which the wings, separately prefabricated, are fitted.

The components are usually made and assembled with reference to a detailed full-scale plan or drawing, and in carrying out the above building operations and in bonding the components together it is important, especially for obtaining proper flying characteristics, to ensure that the fuselage has a straight center line or longitudinal axis, and is not twisted, with all the laminate formers perpendicular to said center line or longitudinal axis, while the tail unit must be properly aligned and symmetrically positioned relative to the fuselage center line with tail plane and tail fin portions in correct relative angular orientation. Also, the wings must of course be carefully fitted and located so that finally the whole assembled and bonded structure is correctly lined up.

SUMMARY OF THE INVENTION

More specifically, the present invention provides a model aircraft construction jig comprising a. an elongate baseboard having at least one longitudinal guide line defining a reference center line;

b. a plurality of fuselage side cramp members which mount upon the baseboard in longitudinally extending rows spaced at opposite sides of said center line so as to present a series of clamping faces engageable with respective side walls of a fuselage assembled on said center line;

c. means providing for selective positional adjustment of each side cramp member, at least in a direction transverse to said center line, when so mounted upon the baseboard and for fixing each said cramp member in adjusted position upon said baseboard; and d. a tail unit locator which mounts on the baseboard towards the rear end thereof in predetermined relationship with said center line and which provides positionally adjustable guide slot means adapted to engage and locate in position portions of the tail unit during assembly and fitting to an assembled fuselage aligned with respect to said center line.

In preferred embodiments of the invention, the baseboard is provided with a series of longitudinal guide lines scribed, printed or otherwise permanently applied to its upper surface, one of these guide lines forming the center line and the others being disposed in spaced parallel relationship each side of the center line. Also, the side cramp members are held in position by screw-threaded studs or bolts and associated clamping nuts, these studs or bolts passing through holes drilled through the baseboard in predetermined positions each side of the center line and through slots in the side cramp members which permit the latter each to be shifted towards and away from the center line and also to pivot angularly about its respective fixing stud or bolt when the associated clamping nut is slackend off, thereby to permit of a wide range of positional adjustment.

Similarly, the tail unit locator is preferably adjustably secured to the baseboard by stud or bolt and clamping nut fixing means which, when slackened off, permits a limited extent of positional adjustment at least in the longitudinal direction of the center line. Preferably, the tail unit locator has a two-part construction and comprises a carrier member which provides an upstanding post and an arm member having a forwardly projecting arm formed with an open-ended slot for engaging and locating the tail fin and rudder portion and the tail plane and elevator portions of the tail unit, means being provided for angular adjustment and height adjustment to bring the slotted arm into the required positions.

The baseboard may be supported by runners underneath, and in accordance with a further preferred feature, a pair of arms are provided which are adapted to be fitted to the baseboard, towards the front end thereof, so as to project laterally therefrom, each arm having means such as a recess or slot adapted to engage and locate the feet portions of landing gear which, in some model designs, is carried by the wings, thereby to facilitate the proper positioning and alignment of such wings in fitting them to the fuselage and proper lining up of the complete structure.

BRIEF DESCRIPTION OF DRAWINGS

By way of example, one form of model aircraft construction jig in accordance with the present invention is illustrated in the accompanying drawings, wherein:

FIG. 1 is a plan view;

FIG. 2 is a part-sectional front end elevational view;

FIG. 3 is a side elevational view, on a larger scale, of a tail unit locator component shown as in use for locating and lining up the rudder and tail fin portion of a tail unit;

FIG. 4 is a similar view to FIG. 3 but showing the tail unit locator in a different position as in use for supporting the tail end of a fuselage;

DESCRIPTION OF SPECIFIC EMBODIMENTS

Figure 5:
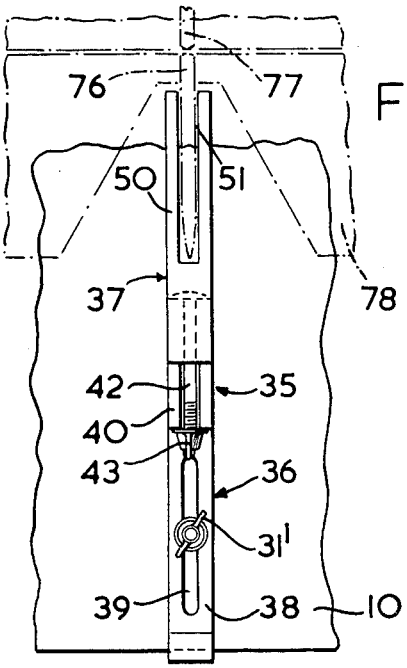
FIGS. 5 and 6 show, respectively, a plan view and a rear elevational view of the tail unit locator when set in the position of FIG. 3.

The jig illustrated in the drawings has a baseboard 10 which is conveniently composed of a chipboard panel faced with a hard plastics laminate covering such as melamine. Suitable dimensions for the baseboard are, for example, a length of 48 inches and a width of 15 inches.

As indicated the panel of the baseboard 10 is adapted to be supported so as to lie horizontally by a pair of spaced apart longitudinal runners 11, 11, conveniently provided by hardwood rails secured to the underside, and the top flat surface is scribed with a central line 13 and with a pair of guide lines 14, 14, spaced in parallel relationship at opposite sides of the center line.

The baseboard panel is also drilled with a series of holes 15, ¼ inch diameter for example, arranged in longitudinally extending rows also disposed at opposite sides of the center line 13, although those holes 15 towards the rear end 17 of the baseboard may be disposed somewhat nearer to the center line then those holes 15 towards the front end 18 of the baseboard. A further similar hole 16 is also drilled on the center line 13 towards the rear end 17.

The holes 15 serve in locating and fixing a number of fuselage side cramp members 20 of which two adjacent the rear end 17 are shown in full lines in FIG. 1 while others are indicated in broken lines.

Each side cramp member 20 is conveniently formed by an L-shaped piece of plywood having two limbs 21 and 22 profiled as seen most clearly in FIG. 2 to provide flat exterior faces 23 and 24 accurately perpendicular to one another. Each side cramp member 20 mounts on the baseboard 10 with its limb 21 extending horizontally so that exterior face 23 is presented downwardly and lies in face contact with the top flat surface of the baseboard, while the other limb 22 is upright with its face 24 in a vertical plane. The limb 22 has an inclined interior face 25 providing a tapering configuration, and the face 24 is faced with a pad 26 composed of rubber or like material which provides a clamping face as hereinafter described.

The limb 21 of each cramp member 20 is formed with a longitudinal slot 28 which enables the cramp member to be located on the baseboard by a coach bolt 30 extending vertically upward through one of the holes 15 and through the slot 28 to engage a wing nut 31 and associated washer. When the wing nut 31 is slackened off, the cramp member 20 is thus able to be turned angularly about the coach bolt 30 and can be slidably adjusted horizontally in the longitudinal direction of limb 21, but upon tightening the wings nut 31 the cramp member 20 is firmly held in its set adjusted position.

The hole 16 serves in similarly locating and fixing, by a coach bolt 30' and washer and wing nut 31', the tail unit locator component which is indicated generally by reference numeral 35.

This tail unit locator 35 comprises, in this embodiment, an L-shaped carrier member 36 and an L-shaped arm member 37. One limb 38 of the carrier member 36 seats on the surface of the baseboard 10 and is formed with a longitudinal slot 39 which accommodates the coach bolt 30' to provide an adjustable fixing of the same kind as for the side cramp member 20, and the other limb 40 forms an upstanding post which the arm member 37 is adjustably securred by a coach bolt 42 and wing nut 43.

The coach bolt 42 extends through a longitudinal slot 41 in limb 40 and through a longitudinal slot 44 in a limb 45 of the arm member 37, this limb 45 having an accurately flat exterior face 47 which engages against an accurately flat exterior vertical face 48 of the carrier member limb 40. The other limb 50 of arm member 37 forms an arm which has an open-ended longitudinally-extending slot 51, and this limb 50 has a tapering profile with an inclined "interior" face 52 and an exterior face 53 which is perpendicular to the face 47.

As indicated diagrammatically in FIGS. 1 and 2, the jig is also provided with a pair of battens forming arms 60, 60, which project laterally from the baseboard 10 towards the front end thereof, each of these arms being formed in its top surface with an accurately positioned and profiled recess 61 for receiving and locating landing gear feet portions of a model aircraft assembled in the jig. These arms 60, 60 are conveniently detachably fixed in predetermined positions to the baseboard 10 by suitable releasable fixing means (not shown).

In use, in a typical building procedure in constructing a model aircraft, after fitting the coach bolts 30 and loosely mounting the side cramp members 20 each side of the center line 13, the fuselage side walls and the formers, each already cut accurately to shape, are assembled in approximately their correct positions between the side cramp members at opposite sides of the center line. At this stage, the tail unit locator 35 may be omitted so that the full length of the baseboard is available for use, and in carrying out the initial assembly operation the fuselage side walls may first be placed in position between the opposite rows of loosely fitted side cramp members. Then, starting for example at the tail end, a former constituting a tail piece spacer is fitted centrally on the center line 13 between the side walls which are clamped thereto by engagement with the clamping faces of the adjacent confronting side cramp members 20 the latter being moved inwards towards the center line and secured in position. The other formers are likewise fitted and located with respect to the center line 13, the side cramp members being successively adjusted so that the series of clamping faces 26 provided thereby bear against the fuselage side walls to clamp them against the formers and set the required profile. Then, after this initial assembly operation which establishes the correct alignment of the fuselage, the formers may be withdrawn, one at a time, after slackening off one of the respective pairs of adjacent confronting side cramp members as necessary, treated with glue or bonding adhesive on the side edges, and replaced, and the clamping pressure from the side cramp members is re-applied while the adhesive sets. Thus, a framework for the fuselage is built up by the side walls and interconnecting formers. In FIG. 1, typical fuselage side walls are indicated in broken lines at 70, 70, and the formers therebetween are indicated at 71 and **71*a*, 71*a* being the tail piece spacer. Usually, the above assembly operation is performed with the fuselage in an inverted condition, and covering with appropriate sheet material of the inverted framework structure thus produced may be commenced while it is still in the jig, although the structure may be raised or moved to a different position after slackening and re-adjusting the fixings of the side cramp members if desired in order to facilitate further operations. For the subsequent building on of the tail unit, however, the fuselage framework will normally be removed and replaced in the jig in an upright condition in which it is again held, aligned with the center line 13, by the re-adjusted side cramp members, and the tail unit locator 35** is then brought into use.

Figure 6:
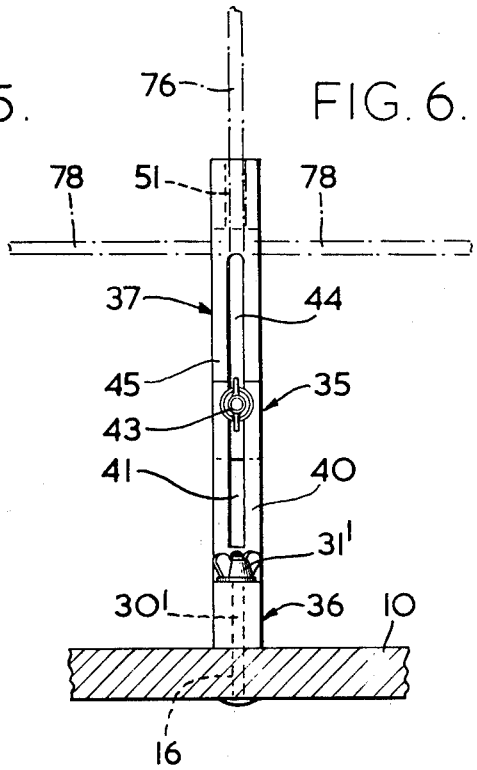

For fitting the rudder and tail fin portion, the tail unit locator 35, mounted on the baseboard and held by the coach bolt 30' and wing nut 31', is set as shown in FIGS. 3, 5 and 6 with the guide slot 51 in a vertical plane passing through the center line 13. With the tail of the fuselage positioned directly below the arm 50, as shown in FIG. 3, the rudder of the tail fin engages within the guide slot 51 so that this portion of the tail unit can thereby be accurately lined up in a vertical plane centrally on the fuselage tail while being glued or bonded permanently to the fuselage.

Figure 7:
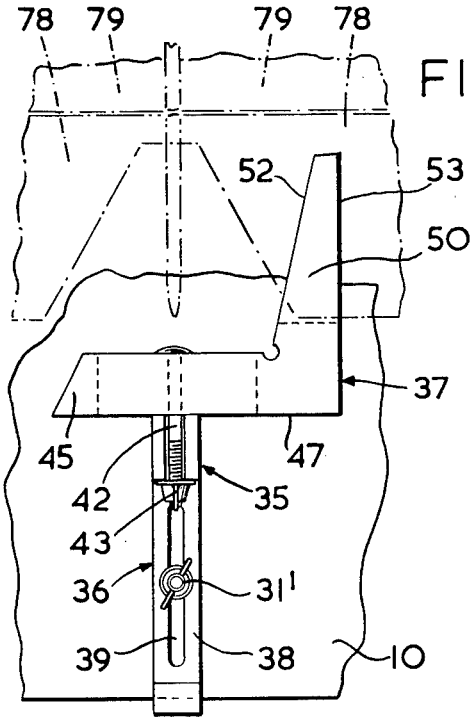
FIGS. 7 and 8 show, respectively, a plan view and a rear elevational view of the tail locator set in another position as in use for locating the elevator and tail plane portions of a tail unit.
Figure 8:
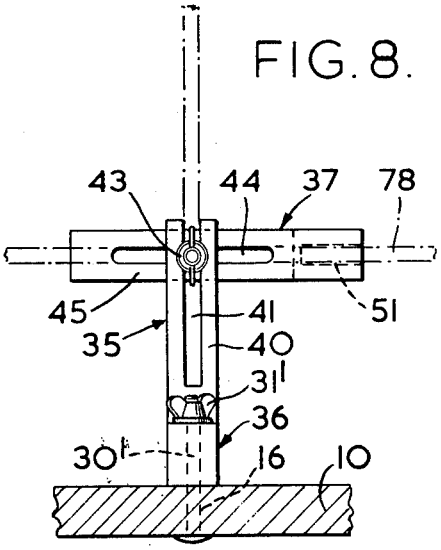

For fitting the elevator and tail plane portions, the wing nut 43 is slacked off and the arm member 37 is turned angularly upon the post 40 and is re-set as shown in FIGS. 7 and 8 so that the guide slot 51 lies in a horizontal plane at a height, relative to the fuselage tail, suitable for locating and accurately lining up the elevator and tail plane portions which are fitted in a manner similar to the rudder and tail fin portion.

In the relevant Figures of the drawings, reference 75 indicates a fuselage tail, 76 is the rudder of a tail fin portion 77 and 78 indicates the elevators of tail plane or stabiliser portions 79.

The form of tail unit locator 35 described and illustrated is very versatile with its range of adjustment characteristics so that it can be set and adapted to facilitate locating and lining up the components of many different designs of tail unit. And, as indicated in FIG. 4, the arm member 37 can be completely inverted so that the face 52 of arm 50 can engage and support the fuselage tail 75 while other work is being performed on the structure. If desired, the two L-shaped members 36 and 37 could alternatively be connected together to provide an overall C-configuration instead of an S-configuration, and many modifications are of course possible in the structural design details of this tail unit locator without departing outside the scope of the invention.

Having built-up the fuselage and tail unit, with the structure in an upright condition still in the jig, the wings may then be fitted and, as indicated previously, the laterally-extending arms 60, 60 secured in predetermined positions to the baseboard 10, can be utilize to facilitate final assembly and lining up by means of the recesses 61, 61, which are adapted to receive and locate the feet portions of landing gear carried, in some kinds of models, by the wings.

The jig described can thus considerably reduce the degree of skill and time necessary in precision assembly of model aircraft, especially flying models, and has a high degree of versatility which enables it to be adapted for use in building models of many different designs of aircraft.

I claim:

1. A model aircraft construction jig comprising, in combination:

a. an elongated baseboard having at least one longitudinal guideline defining a reference centerline thereupon, b. a plurality of fuselage side cramp members each having a vertically disposed clamping face, c. means for fixing said side cramp members on the baseboard so that they are located in longitudinally-extending rows spaced at opposite sides of said reference centerline, d. said fixing means being adjustable to provide for selective positional adjustment of each side cramp member whereby said clamping faces of the side cramp members can engage respective side walls of a model aircraft fuselage assembled on said centerline, e. a tail unit locator, and f. means for mounting and fixing said tail unit locator on the baseboard towards the rear end thereof in predetermined relationship to said centerline, g. said tail unit locator having positionally adjustable guide slot means adapted to engage and locate in position portions of a model aircraft tail unit during assembly thereof and fitting to an assembled fuselage aligned with respect to said centerline, h. said tail unit locator has a two-part construction comprising a carrier member having an upstanding post, an arm member having a forwardly-projecting arm, and adjustable connecting means connecting together the carrier member and arm member, i. said tail unit mounting and fixing means being adapted to mount adjustably and secure said carrier member upon the baseboard, j. said forwardly-projecting arm having an open-ended slot for engaging and locating the tail fin and rudder portion and tail plane and elevation portions of the tail unit, and k. the adjustable connecting means being adapted to provide angular adjustment and height adjustment of the arm member upon the carrier member thereby to bring said forwardly-projecting arm into the required positions for selectively locating said portions of the tail unit.

2. A model aircraft construction jig according to claim 1, wherein said carrier member and arm member of the tail unit locator each have two limbs extending substantially perpendicularly to one another to provide an L-shaped configuration, and said adjustable connecting means comprises an adjustable screw and nut clamping device connecting together in face-to-face relationship one said limb of the carrier member which constitutes said upstanding post and one said limb of the arm member which is perpendicular to the other limb constituting said forwardly projecting arm.

3. A model aircraft construction jig according to claim 1, wherein the said cramp members each comprise a vertical limb and a horizontal limb extending substantially perpendicularly to one another to provide an L-shaped configuration, said vertical limb having a planar exterior surface portion to provide the said vertically disposed clamping face, and the horizontal limb having a planar undersurface and a longitudinal slot therein, said baseboard has a series of holes and the side cramp member fixing means comprises screw-threaded stud and nut clamping devices which engage said holes in the baseboard and the longitudinal slot in the horizontal limb of said side cramp members.

4. A model aircraft construction jig according to claim 1, further comprising a pair of landing gear locating arms, means for detachably connecting said arms to the baseboard, towards the front end thereof, so as to project laterally therefrom, and recess means in each arm for engaging and locating feet portions of landing gear incorporated in a model aircraft assembled in said jig.

5. A model aircraft construction jig comprising, in combination:

a. an elongated baseboard having at least one longitudinal guideline disposed thereon, b. a first set of fuselage side cramp members each having a vertically disposed abutment face, c. a second set of fuselage side cramp members each having a vertically disposed abutment face, d. means for fixing said side cramp members of said first and second sets on the baseboard, e. said side cramp members of said first and second sets being located and spaced apart at intervals in respective first and second rows extending longitudinally of the baseboard at opposite sides of said longitudinal guideline, f. said abutment faces of said cramp members of said first and second rows being effective to engage respective opposite first and second side walls of a model aircraft fuselage assembled symmetrically about said longitudinal guideline, g. a tail unit locator, and h. means for mounting and fixing said tail unit locator on the baseboard towards the rear end thereof in predetermined relationship to said longitudinal guideline, i. said tail unit locator having positionally adjustable guide slot means adapted to engage and locate in position portions of a model aircraft tail unit during assembly thereof and fitting to an assembled fuselage aligned with respect to said longitudinal guideline.

6. A model aircraft construction jig comprising, in combination:

a. an elongated baseboard having at least one longitudinal guideline disposed thereon, b. a first set of fuselage side cramp members each having a vertically disposed abutment face, c. a second set of fuselage side cramp members each having a vertically disposed abutment face, d. means for fixing said side cramp members of said first and second sets on the baseboard, e. said side cramp members of said first and second sets being located and spaced apart at intervals in respective first and second rows extending longitudinally of the baseboard at opposite sides of said longitudinal guideline, f. said abutment faces of said cramp members of said first and second rows being effective to engage respective opposite first and second side walls of a model aircraft fuselage assembled symmetrically about said longitudinal guideline, g. a pair of landing gear locating arms, h. means for detachably connecting said arms to the baseboard, toward the front end thereof, so as to project laterally therefrom, and i. recess means in each arm for engaging and locating feet portions of landing gear incorporated in a model aircraft assembled in said jig.

7. A model aircraft construction jig according to claim 5, wherein the tail unit locator having a two-part construction comprising a carrier member having an upstanding post, an arm member having a forwardly-projecting arm, and adjustable connecting means connecting together the carrier member and arm member, said tail unit mounting and fixing means being adapted to mount adjustably and secure said carrier member upon the baseboard, said forwardly-projecting arm having an open-ended slot for engaging and locating the tail fin and rudder portion and tail plane and elevation portions of the tail unit, and the adjustable connecting means being adapted to provide angular adjustment and height adjustment of the arm member upon the carrier member thereby to bring said forwardly-projecting arm into the required positions for selectively locating said portions of the tail unit.

8. A model aircraft construction jig according to claim 7, wherein said carrier member and arm member of the tail unit locator each have two limbs extending substantially perpendicular to one another to provide an L-shaped configuration, and said adjustable connecting means comprises an adjustable screw and nut clamping device connecting together in face-to-face relationship one said limb of the carrier member which constitutes said upstanding post and one said limb of the arm member which is perpendicular to the other limb constituting said forwardly-projecting arm.

9. A model aircraft construction jig according to claim 5, wherein said cramp members each comprise a vertical limb and a horizontal limb extending substantially perpendicularly to one another to provide an L-shaped configuration, said vertical limb having a planar exterior surface portion to provide said vertically disposed clamping face, and the horizontal limb having a planar undersurface and a longitudinal slot therein, said baseboard has a series of holes and the side cramp member fixing means comprises screw-threaded stud and nut clamping devices which engage said holes in the baseboard and said longitudinal slot in the horizontal limb of said side cramp members.

* * * * *